US008220637B2

(12) United States Patent
Mannillo

(10) Patent No.: US 8,220,637 B2
(45) Date of Patent: Jul. 17, 2012

(54) MEMORIES BOX

(76) Inventor: Richard William Mannillo, Wareham, MA (US)

( * ) Notice: Subject to any disclaimer, the term of this patent is extended or adjusted under 35 U.S.C. 154(b) by 0 days.

(21) Appl. No.: 13/278,002

(22) Filed: Oct. 20, 2011

(65) Prior Publication Data

US 2012/0097572 A1 Apr. 26, 2012

Related U.S. Application Data

(60) Provisional application No. 61/405,323, filed on Oct. 21, 2010.

(51) Int. Cl.
*B65D 71/00* (2006.01)

(52) U.S. Cl. ..... 206/576; 206/457; 434/429

(58) Field of Classification Search ..... 206/216, 206/218, 576, 577, 579, 555, 457; 434/428, 434/429

See application file for complete search history.

(56) References Cited

U.S. PATENT DOCUMENTS

| | | | | | |
|---|---|---|---|---|---|
| 2,470,993 | A | * | 5/1949 | Kramer | 312/217 |
| 3,414,987 | A | * | 12/1968 | Lindenauer | 434/429 |
| 4,497,401 | A | * | 2/1985 | Ackerman | 206/131 |
| 5,462,168 | A | * | 10/1995 | Oberhelman et al. | 206/457 |
| 6,000,849 | A | * | 12/1999 | Keller et al. | 383/80 |
| 6,082,545 | A | * | 7/2000 | Ford et al. | 206/579 |

* cited by examiner

*Primary Examiner* — Jacob K Ackun
(74) *Attorney, Agent, or Firm* — Michael Ries

(57) ABSTRACT

The present invention is a memories box that includes a rectangular box with a lid, an open side, with a pair of inner edges and a front with a plurality of grooves disposed on the pair of inner edges, a slidable planar side with a front facing that horizontally slides into the grooves and a supplemental rectangular box that includes a front side with a centered aperture, an interior portion with an interior storage compartment with a top with a pair of apertures and a removable top with a centered aperture that is removably slid inside the rectangular box to perform a presentation. The invention also includes a method for using a memories box to perform a presentation such as presenting a gift or present during a gift-giving occasion.

20 Claims, 7 Drawing Sheets

MEMORIES BOX

This application claims priority to U.S. Provisional Application 61/405,323 filed on Oct. 21, 2010, the entire disclosure of which is incorporated by reference.

TECHNICAL FIELD & BACKGROUND

The present invention generally relates to a box. More specifically, the invention is a memories box.

It is an object of the invention to provide a memories box to store and accommodate a plurality of recipes or other memorabilia written or displayed on 8.5"×11" paper and any needed corresponding storage folders.

It is an object of the invention to provide a memories box that provides a supplemental box to store one or more supplemental objects and/or items.

It is an object of the invention to provide a method of using a mechanism hidden in the memories box to perform a presentation such as giving a gift or receiving a gift to a person.

What is really needed is a memories box to store and accommodate a plurality of recipes written on 8.5"×11" paper and any needed corresponding storage folders that provides a supplemental box to store one or more supplemental objects and/or items and that includes a method of using the memories box to perform a presentation such as giving a gift to a person.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

Figure 1A:
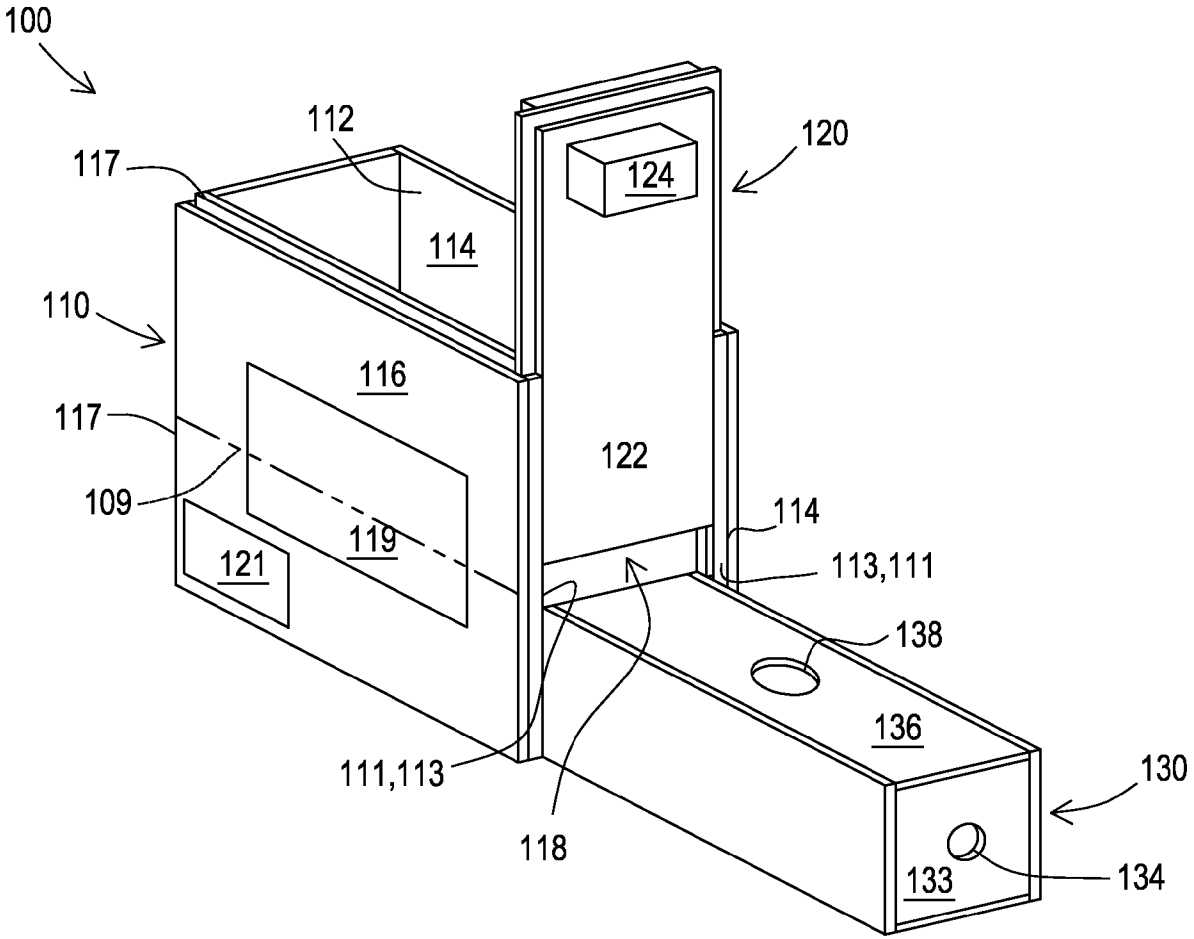
FIG. 1A illustrates a front side perspective view of a memories box, in accordance with one embodiment of the present invention.

FIG. 1A illustrates a front side perspective view of a memories box 100, in accordance with one embodiment of the present invention.

The memories box 100 includes a rectangular box 110, a slidable planar side 120 and a supplemental rectangular box 130.

The rectangular box 110 includes an open top 112, an inner box 114, a front 116, a distal side 117 and a proximal side 118. The open top 112 is designed to allow a user to access a false bottom 109 disposed within the rectangular box 110. The inner box 114 is disposed with the rectangular box 110. The front 116 optionally includes a drawing 119 or photo as well as a manufacturer's stamp 121 disposed on the bottom 117 for aesthetic or decorative purposes. The distal side 117 is a dosed side without any openings. The proximal side 118 includes a plurality of grooves 111 disposed on a pair of sides 113 of the proximal side 118.

The slidable planar side 120 includes a front facing 122 that vertically slides into the plurality of grooves 111. The slidable planar side 120 has a handle 124 disposed on the front facing 122 to allow a user to aide the slidable planar side 120 vertically up and down along the grooves 111 or to slide the slidable planar side 120 off of the grooves 111. The slidable planar side 120 is approximately 5¼ inches wide but can be other suitable widths as well. The supplemental rectangular box 130 includes a front side 132 with a centered aperture 134 and a permanently glued top 136 with a centered aperture 138 that is removably did inside the rectangular box 110. Further details regarding the supplemental rectangular box 130 are described and illustrated in FIG. 1B and its description. All of the components utilized to form the memories box 100 are assembled with a plurality of dose tolerance and precision-cut components. The memories box 100 and its components are typically made of wood but can be made of other suitable material as well.

Figure 1B:
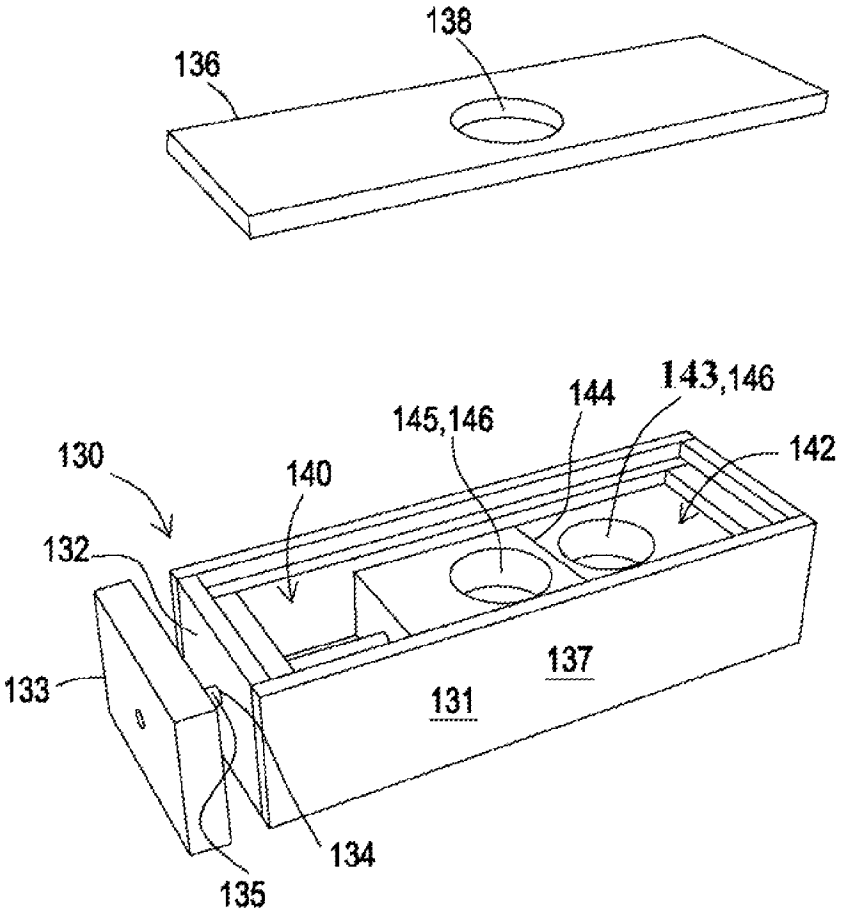
FIG. 1B illustrates an exploded side overhead perspective view of a supplemental box of a memories box, in accordance with one embodiment of the present invention.

FIG. 1B illustrates an exploded side overhead perspective view of a supplemental box 130 of a memories box 100, in accordance with one embodiment of the present invention.

As previously described and illustrated in FIG. 1A and its description, the supplemental rectangular box 130 includes the front side 132 with the centered aperture 134, the pair of sides 131 and the permanently glued top 136 with a centered aperture 138 that is removably slid inside the rectangular box 110.

The pair of sides 131 can have disposed indicia 137 such as one or more wish related quotations. The front side centered aperture 134 accommodates a handle 133 that includes a horizontal stem 135 that extends through the centered aperture 134. The supplemental rectangular box 130 additionally includes an interior portion 140 with an interior storage compartment 142 with a top 144. A pair of apertures 146 is disposed on the top 144. The interior portion 140 is integral to the horizontal stem 135 and the handle 133 and can be moved horizontally within the supplemental rectangular box 130 manually with the horizontal stem 135 and the handle 133. The interior storage compartment 142 removably stores one or more objects or items that are typically a surprise, gift or a present (not shown). The pair of apertures 146 that includes a first aperture 145 and a second aperture 143 is disposed on the interior storage compartment top 144 to allow a user to access and remove the one or more objects or items. The one or more objects or items can also be accessed and removed from the exterior of the memories box 100 through the permanently glued top 136 with a centered aperture 138 and the pair of apertures 146 disposed on the interior storage compartment top 144. Note that the permanently glued top 136 with a centered aperture 138 is illustrated unattached to the supplemental rectangular box 130 in an exploded perspective view of FIG. 1B for illustration purposes only.

Figure 1C:
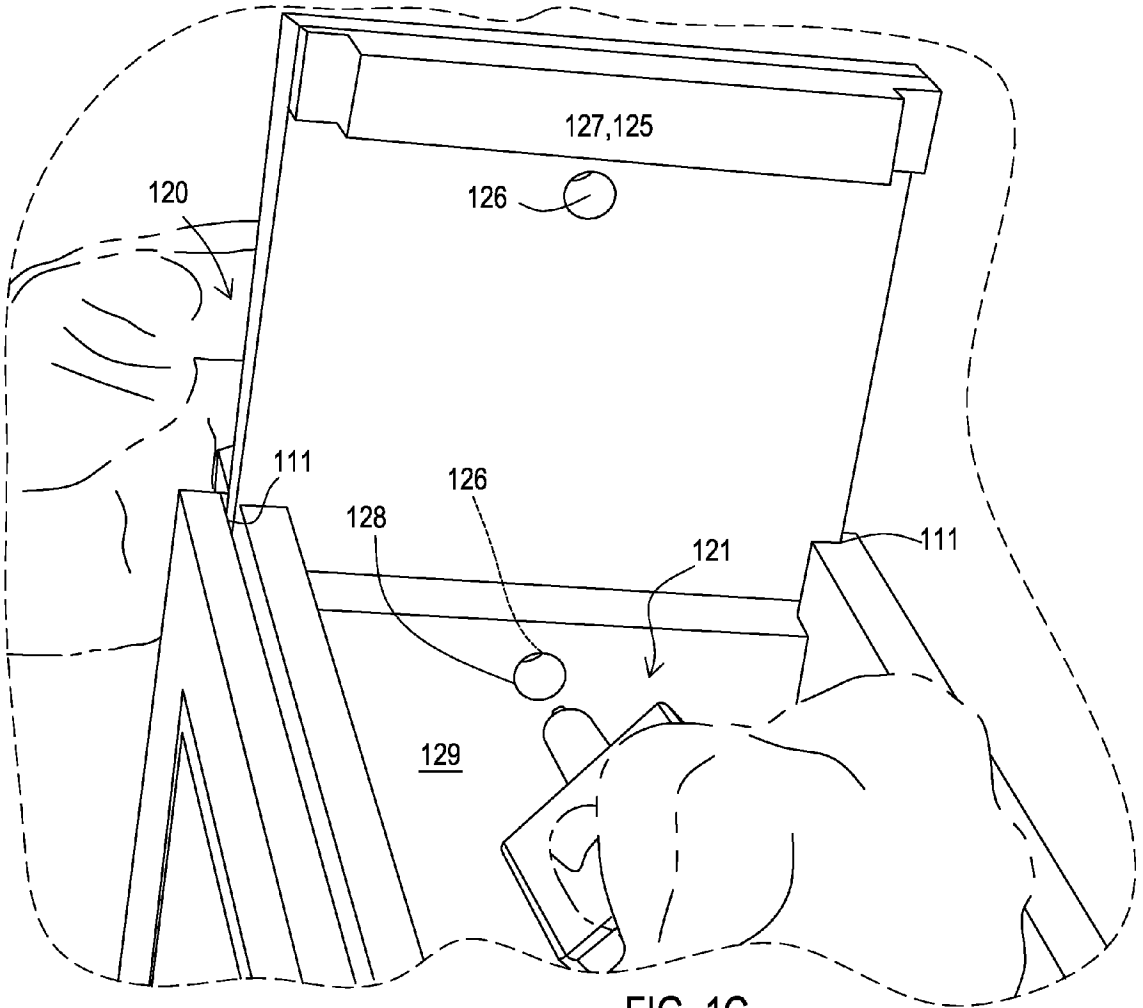
FIG. 1C illustrates a perspective view of a slidable planar side, in accordance with one embodiment of the present invention.

FIG. 1C illustrates a perspective view of a slidable planar side 120, in accordance with one embodiment of the present invention.

Figure 1D:
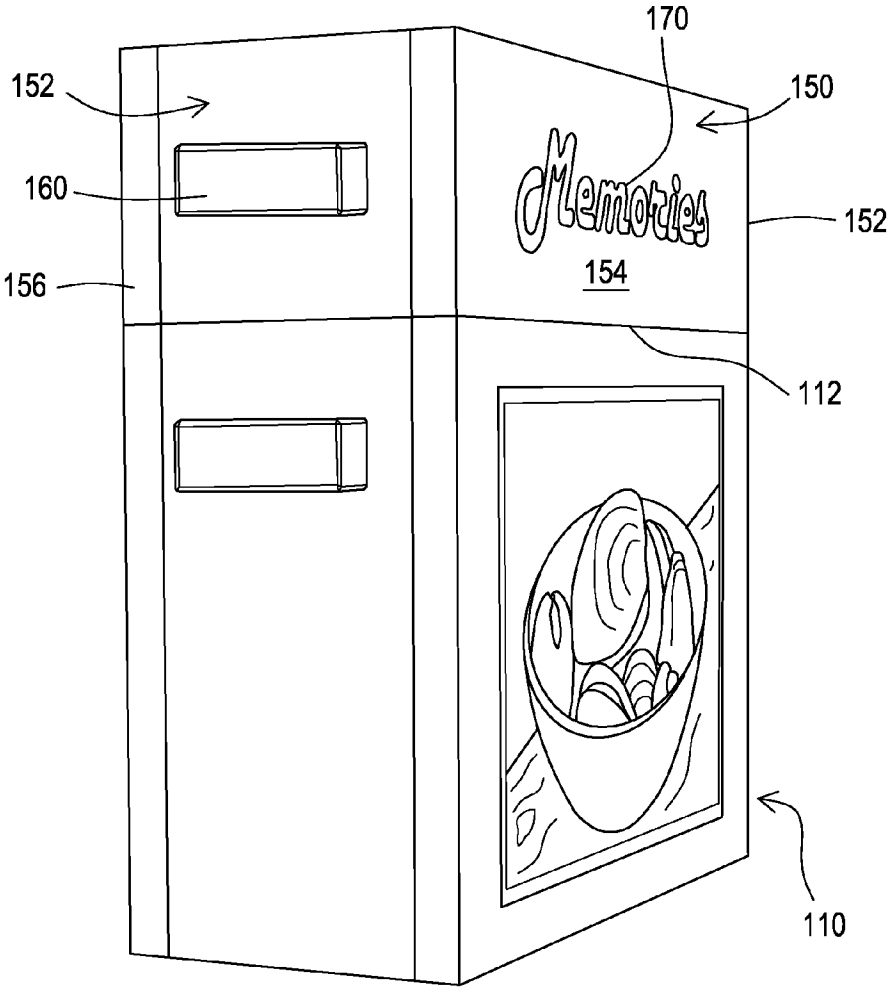
FIG. 1D illustrates a side perspective view of a memories box with a fitted top, in accordance with one embodiment of the present invention.

As previously described and illustrated in FIG. 1A and its description, the slidable planar side 120 includes a front facing 122 that vertically slides into the plurality of grooves 111. The slidable planar side 120 has a handle 124 disposed on the front facing 122 to allow a user to slide the slidable planar side 120 vertically up and down along the grooves 111 or to slide the slidable planar side 120 off of the grooves 111. There is also a pair of apertures 126 disposed on the slidable planar side 120. There is also a single aperture 128 disposed on a vertical wall 129 positioned behind the grooves 111 and the slidable planar side 120. The single aperture 128 and one of the pair of apertures 126 can be aligned controlling and securing and setting the height of the slidable planar side 120 in relation to the supplemental rectangular box 130. Once aligned, a dowel 121 can be inserted into the aligned apertures 126,128, securing the height of the slidable planar side 120 in relation to the supplemental rectangular box 130. There is also a protruding horizontal stop 127 that is disposed approximate to an inside top portion 125 of the slidable planar side 120. Secure the positioning FIG. 1D illustrates a side perspective view of a memories box 100 with a fitted top 150, in accordance with one embodiment of the present invention. The memories box illustrated in FIG. 1D includes all of the previously described and illustrated components in FIGS. 1A-1C that include the rectangular box 110, the slidable planar side 120 and the supplemental rectangular box 130 and their supplemental elements.

The fitted top 150 includes a one or more grasping handles 160 and one or more indicia 170. The fitted top 150 includes two ends 152, a front side 154 and a back side 156 that is removable placed on the open top 112 of the rectangular box 110 to cover and protect any materials or objects placed in the rectangular box 110. The grasping handles 160 are disposed on one or both ends 152 of the fitted top 150 to avow the user to grasp and remove or place the fitted top 150 onto or off of the rectangular box 130. The indicia 170 can be the word "memories" disposed on the front side 154 and/or the back side 156 of the rectangular box 130.

Figure 1E:
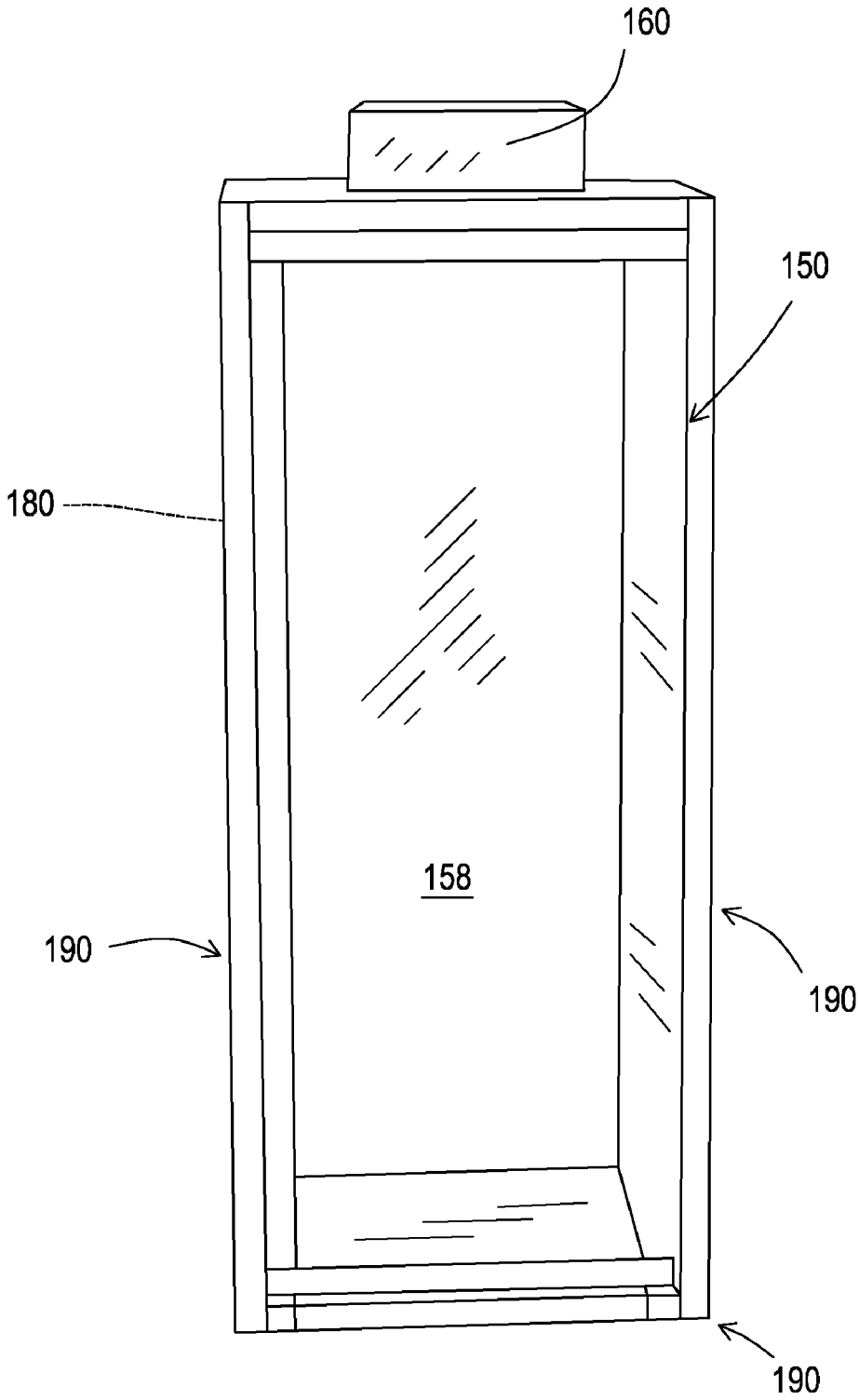
FIG. 1E illustrates a front view of a memories box with a fitted top, in accordance with one embodiment of the present invention.

FIG. 1E illustrates a front view of a memories box 100 with a fitted top 150, in accordance with one embodiment of the present invention.

The fitted top 150 has an interior 158, a top 180 and a beveled bottom perimeter 190. The interior 158 allows for additional space to accommodate higher objects such as files and papers that extend above the open top 112 of the rectangular box 110 while still being protected. The top 180 is a permanently attached top that is attached to the fitted top 150 that protects and covers the contents of the rectangular box 110. The beveled bottom perimeter interior 190 corresponds to the open top 112 of the rectangular box 110 to provide a secure removable fit to the rectangular box 110.

Figure 2:
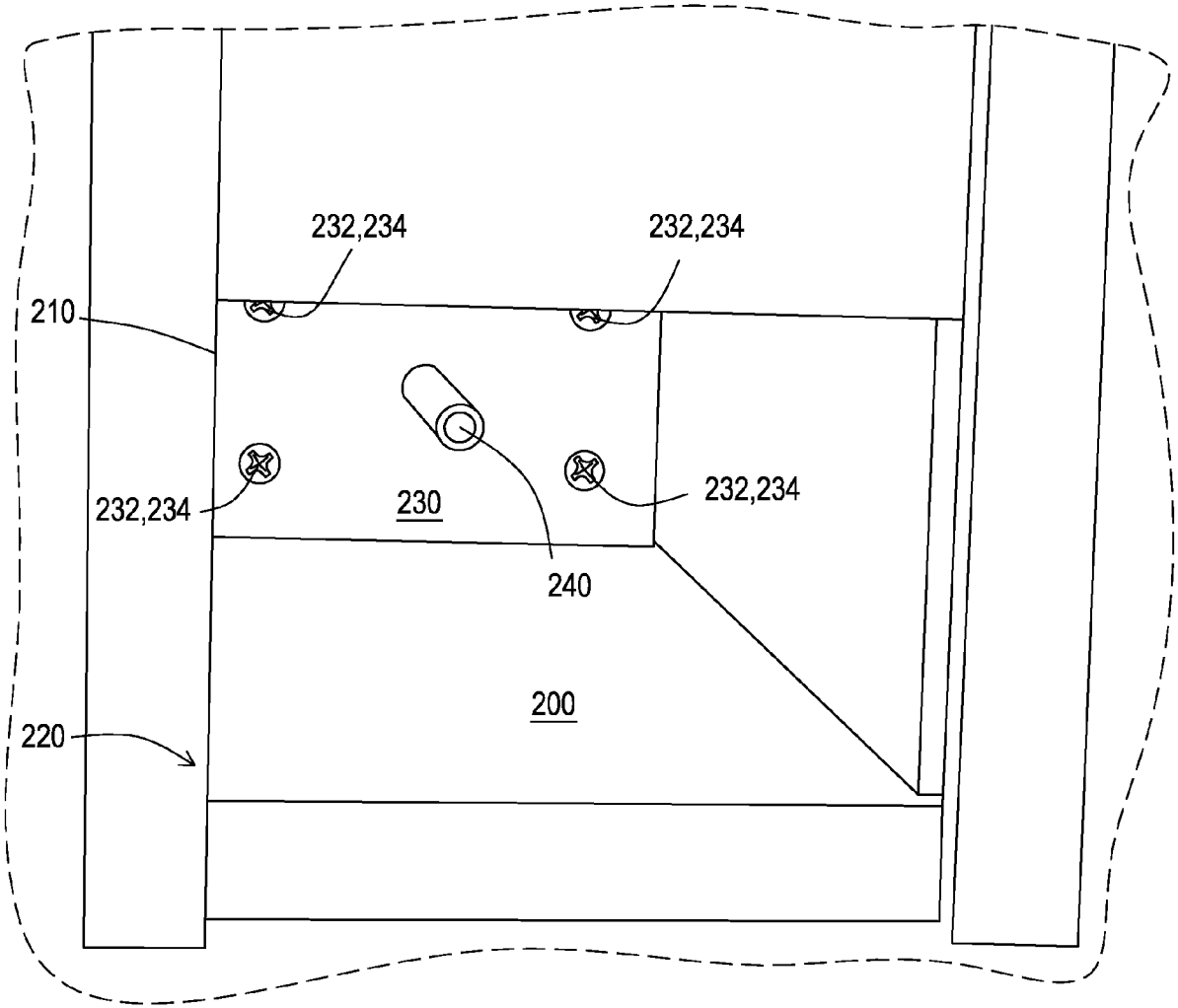
FIG. 2 illustrates a front view of an interior below the false bottom, in accordance with one embodiment of the present invention.

FIG. 2 illustrates a front view of an interior 200 below the false bottom 109, in accordance with one embodiment of the present invention. The interior 200 below the false bottom 109 is configured to correspondingly accommodate the supplemental rectangular box 130 being horizontally slid into or out of the interior 200 below the false bottom 109, in accordance with one embodiment of the present invention.

The interior 200 includes a distal end 210, a proximal end opening 220, a side base 230 and a horizontally protruding stem 240. The distal end 210 is closed and is the inside part of the distal side 117 of the rectangular box 110 previously described in FIG. 1A. The proximal end opening 220 is configured to correspondingly accommodate the supplemental rectangular box 130 being horizontally slid into or out of the interior 200 below the false, bottom 109. The supplemental rectangular box 130 can be removed and utilized in a gift giving presentation described in the subsequent method of use of the memories box 100 in the flowchart in FIG. 3. The side base 230 is secured to the distal end 210 of the interior 200 with a plurality of screws 232 that are typically set approximate to the corners 234 of the side base 230 to the distal end 210. The horizontally protruding stem 240 protrudes horizontally outward to receive a second centered aperture (not shown) disposed on the back side (not shown) of the supplemental rectangular box 130. The horizontally protruding stem 240 extends through the supplemental box 130 and is in contact with the interior portion 140 to move the interior portion 140 within the supplemental rectangular box 130.

Figure 3:
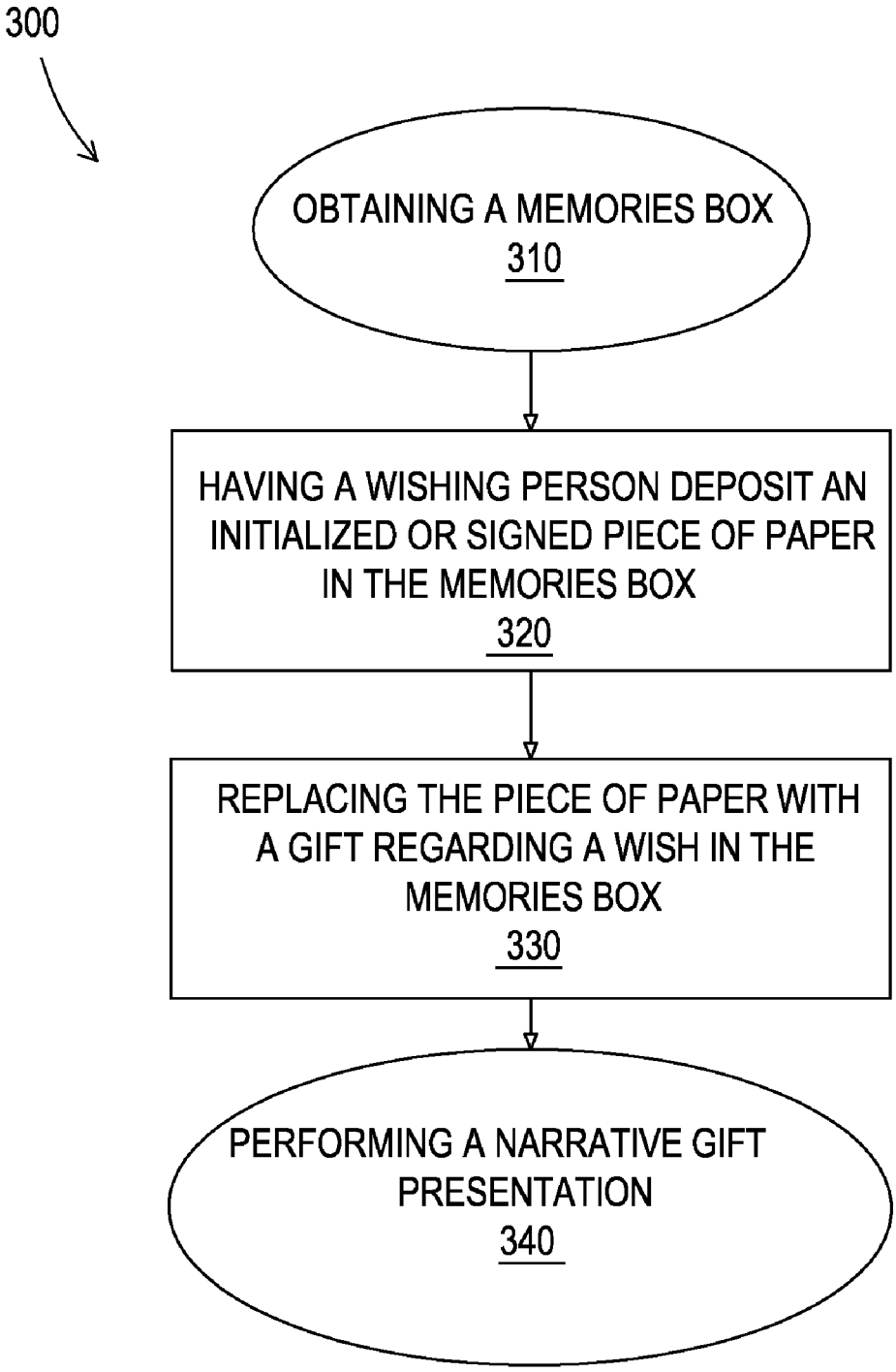
FIG. 3 illustrates a flow chart of a method for using a memories box to perform a presentation, in accordance with one embodiment of the present invention.

FIG. 3 illustrates a flow chart of a method 200 for using a memories box, in accordance with one embodiment of the present invention.

The method 300 exclusively utilizes the memories box described and illustrated in FIGS. 1A, 1B and 1C and their descriptions. As previously indicated, the memories box includes a rectangular box specifically that includes a top, an open side with a pair of inner edges and a front with a plurality of grooves disposed on the pair of inner edges, a slidable planar side with a front facing that horizontally slides into the grooves and a supplemental rectangular box that includes a front side with a centered aperture, an interior portion with an interior storage compartment with a top with a pair of apertures and a removable top with a centered aperture that is removably slid inside the rectangular box to perform a presentation.

The method 300 includes the steps of obtaining a memories box 310, having a wishing person deposit an initialized or signed wish displayed on a piece of paper in an interior storage compartment of the memories box 320, replacing the piece of paper with a gift regarding the wish in the memories box 330 and performing a narrative gift presentation regarding the initialized or signed wish 340.

The step of obtaining a memories box 310 can be obtained by a company that manufactures the memories box, ordering a memories box online or purchasing a memories box at a retail store. The step of having a wishing person deposit an initialized or signed wish displayed on a piece of paper in an interior storage compartment of the memories box 320 can be for any person wishing for a present that writes the wish down on a piece of paper or other media and places the piece of paper in the interior portion with an interior storage compartment of the supplemental rectangular box folded. The step of replacing the piece of paper with a gift regarding the wish in the memories box 330 involves taking out the paper with the wish and obtaining the wish which is typically a present or gift. The supplemental rectangular box is then rotated 180 degrees and placed back into the supplemental rectangular box to give the illusion that the piece of paper with the wish request is replaced with a gift that is typically a requested gift given in the supplemental rectangular box but can be any suitable gift. The present or gift is than placed into the other aperture of the interior portion with an interior storage compartment of the supplemental rectangular box. The step of performing a narrative gift presentation regarding the initialized or signed wish 340 then is made to the person receiving the gift with the gift receiving person retrieving their gift from the other aperture of the interior portion with an interior storage compartment of the supplemental rectangular box.

The method 300 and a plurality of method variation examples can optionally also be performed and stored on a DVD for future reference.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A memories box to store a plurality of recipes, comprising:

a rectangular box with an open top, an inner box with an interior, a front and an open side with a pair of sides;

a slidable planar side with a front facing and an inside top that vertically slides into a plurality of grooves that has a handle disposed on said front facing to allow a user to slide said slidable planar side vertically up and down said grooves and a vertical wall with a single aperture positioned behind said grooves and said slidable planar side;

a fitted top includes two ends, a front side and a back side that is removable placed on said open top of said rectangular box to cover and protect any materials or objects placed in said rectangular box includes a one or more grasping handles and one or more indicia disposed on said front of said fitted top; and a supplemental rectangular box that includes a front side with a centered aperture and a pair of sides and a permanently glued top with a centered aperture and an interior portion with an interior storage compartment with a top that is slid inside said supplemental rectangular box.

2. The memories box according to dam 1, wherein said open top allows said user to access said supplemental box disposed within said rectangular box.

3. The memories box according to claim 1, wherein said inner box is disposed within said first box.

4. The memories box according to claim 1, wherein said rectangular box includes a drawing disposed on said front of said rectangular box.

5. The memories box according to claim 1, wherein said rectangular box includes a manufacturer's stamp disposed on said bottom.

6. The memories box according to claim 1, wherein said open side includes a plurality of grooves disposed on said sides.

7. The memories box according to claim 1, wherein said slidable planar side includes a pair of disposed apertures.

8. The memories box according to claim 7, wherein said single aperture and one of said pair of disposed apertures on said planar side are aligned.

9. The memories box according to claim 8, wherein said aligned apertures have a dowel inserted into said aligned apertures to control and set a height of said slidable planar side in relation to said supplemental rectangular box.

10. The memories box according to claim 1, wherein said front side centered aperture accommodates a handle with a horizontal stem that extends through said centered aperture of said front side.

11. The memories box according to claim 10, wherein said interior portion is integral to said horizontal stem and said handle and is moved horizontally within said supplemental rectangular box.

12. The memories box according to claim 1, wherein said interior storage compartment removably stores one or more gifts.

13. The memories box according to claim 12, wherein a pair of apertures are disposed on said interior storage compartment top to access and remove said one or more objects or items.

14. The memories box according to claim 1, wherein said indicia disposed on said front of said fitted top is a word memories.

15. The memories box according to claim 1, wherein said supplemental rectangular box has indicia disposed on said sides.

16. The memories box according to claim 15, wherein said indicia are one or more wish related quotations.

17. A method for using a memories box with a rectangular box with a lid, an open side with a pair of inner edges and a front with a plurality of grooves disposed on said pair of inner edges, a slidable planar side, with a front facing that horizontally slides into said grooves, and a supplemental rectangular box that includes a front side with a centered aperture, an interior portion with an interior storage compartment with a top with a pair of apertures and a removable top with a centered aperture that is removably slid inside said rectangular box to perform a presentation, comprising:

obtaining a memories box;

having a wishing person deposit an initialized or signed wish displayed on a piece of paper in an interior storage compartment of said memories box;

replacing said piece of paper with a gift regarding said wish in said deposited memories box; and performing a narrative gift presentation regarding said initialized or signed wish.

18. The method according to claim 17, wherein said interior portion is integral to said horizontal stem and said handle and is moved horizontally within said supplemental rectangular box.

19. The method according to claim 17, wherein said performing step includes giving said gift to said wishing person wherein said supplemental rectangular box is then rotated 180 degrees and placed back into said supplemental rectangular box to give an illusion that said piece of paper with said wish request is replaced with a gift.

20. The method according to claim 17, wherein said method is performed and stored on a DVD.

* * * * *